US005908351A

United States Patent [19]

Tanaka

[11] Patent Number: 5,908,351

[45] Date of Patent: Jun. 1, 1999

[54] COVER DEVICE UNIT FOR A COIN SORTING APPARATUS

[75] Inventor: Yoshinobu Tanaka, Iwatsuki, Japan

[73] Assignee: Asahi Seiko Kabushiki Kaisha, Tokyo, Japan

[21] Appl. No.: 08/865,969

[22] Filed: May 30, 1997

[30] Foreign Application Priority Data

| | | | |
|---|---|---|---|
| May 30, 1996 | [JP] | Japan | 8-174063 |
| May 30, 1996 | [JP] | Japan | 8-174064 |
| May 30, 1996 | [JP] | Japan | 8-174065 |

[51] Int. Cl.[6] ..... G07D 3/04

[52] U.S. Cl. ..... 453/11

[58] Field of Search ..... 453/3, 4, 11, 7; 194/310, 316

[56] References Cited

U.S. PATENT DOCUMENTS

| | | | |
|---|---|---|---|
| 3,340,980 | 9/1967 | Martin | 453/3 |
| 4,072,156 | 2/1978 | Abe | 453/11 |
| 4,178,502 | 12/1979 | Zimmermann . | |
| 4,315,567 | 2/1982 | Pipand | 453/3 |
| 5,059,153 | 10/1991 | Goi | 453/11 |
| 5,135,096 | 8/1992 | Ward, II | 194/310 |
| 5,163,868 | 11/1992 | Adams et al. | 453/11 |
| 5,496,211 | 3/1996 | Zimmermann . | |
| 5,562,536 | 10/1996 | Uchida et al. . | |

FOREIGN PATENT DOCUMENTS

| | | |
|---|---|---|
| 1356044 | 6/1974 | United Kingdom . |
| 2269257 | 2/1994 | United Kingdom . |
| 94/04997 | 3/1994 | WIPO . |

*Primary Examiner*—F. J. Bartuska
*Assistant Examiner*—Bryan J. Jaketic
*Attorney, Agent, or Firm*—Sughrue, Mion, Zinn, Macpeak & Seas, PLLC

[57] ABSTRACT

A coin sorting apparatus comprising a combination of a separating device unit and a cover device unit, the cover device unit being operative to guide sorted coins separately and in a substantially standing position but with a slant along a path for sorting and collection The separating device unit includes a guide wall for guiding the coins and having a plurality of adjustable sized windows for selectively receiving the coins for sorting and collection The cover device unit has a motor-driven belt that with the guide wall defines the path and is oscillated to open and close a gap between the moving belt to effect movement of coins of variable size along the path.

24 Claims, 8 Drawing Sheets

COVER DEVICE UNIT FOR A COIN SORTING APPARATUS

DETAILED DESCRIPTION OF THE INVENTION

This invention relates to a coin sorting apparatus for sorting coins of different denominations of a given currency into group of coins of each denomination.

This invention relates more specifically to a coin sorting apparatus for sorting coins of a variety of denominations, including but not limited to one cent coins, 5 cent coins, 10 cent coins, 25 cent coins, 50 cent coins, and one dollar coins, or similar coins of different currency, into groups of coins of each denomination, and for storing the sorted coins separately.

Further, this invention relates to a coin sorting apparatus used in the technical fields where it is required to sort coins of different denominations into groups of coins of each denomination and to store the sorted coins separately, for example, technical fields related to retail shops or automatic vending machines where change is required.

Although the present invention is explained with respect to disk-shaped coins, it would be clear to one of ordinary skill that the present invention also may be applied to the sorting of round disk members such as medals used in game machines and the like.

BACKGROUND ART

U.S. Pat. No. 5,562,536 (the '536 Patent) discloses a coin separating apparatus for separating coins of different denominations of currency into groups of coins of each denomination, and is assigned to the assignee of this application.

The '536 Patent discloses an apparatus where the coins are separated according to denomination and are stored as separated. This coin separating apparatus utilizes a gauge plate which is made from a steel plate or the like, and which has a ring shape with a wide width wherein the periphery portion of the gauge plate is slanted and the slanted portion is provided with holes for every denomination.

In other words, the apparatus is characterized in that the slanted portion is provided with holes which are formed by considering the diameters of the coins of every denomination of interest. The holes are arranged on a circle that is concentric with the periphery of the gauge plate.

However, the coin separating and sorting apparatus is designed to be compatible with the provision of a circular shape to the whole structure of the apparatus. Therefore, the store devices for the coins of every denomination to be separated must be arranged so as to be in one plane. Even if the size of the whole structure of the apparatus is made larger, because of this requirement, the space to store a plural kind of the coins is relatively limited. In other words, there is a problem that the design flexibility is decreased and the space for the arrangement is limited in the case where plural store devices must be arranged for the coins of every denomination, since the above-mentioned coin sorting apparatus is designed on the basis of its circular shape.

It is an object of the present invention to provide a coin sorting apparatus which is made smaller in size.

It is another object of the present invention to provide a coin sorting apparatus which has a structure such that a plurality of different sized coins move in a straight path in an upright standing posture and which has a relatively larger space for the store devices for storing the coins sorted into every denomination.

It is a further object of the present invention to provide a coin sorting apparatus which can be disassembled into two large parts in order to facilitate its maintenance and inspection.

SUMMARY OF THE INVENTION

The present invention is a coin sorting apparatus comprising a combination of a sorting device unit and a cover device unit the cover device unit being operative to guide sorted coins along a track for collection.

The present invention comprises a coin sorting apparatus with a cover device unit and a separating device unit, including at least an upper side cover wall defining a path along which a plurality of different sized coins can move separately, disposed in a standing posture with a slant.

The present invention further includes such a coin sorting apparatus unit characterized in that the side cover wall is electrically conductive The present invention comprises such a coin. separating apparatus characterized in that a bottom wall constitutes the path for seriatem movement of different coins.

In addition, according to the present invention, the bottom wall is electrically conductive.

Furthermore, according to the present invention, the cover device unit is characterized by a cover wall means, in the form of a belt or the like, that is movable.

The present invention also comprises a cover device unit characterized in that a cover wall opens and closes a space between itself and a guide wall.

Finally, the present invention comprises a coin separating apparatus as set forth above having at least one of a device for receiving a group of coins, a device for arranging the coins in series and a device for detecting the coins.

BRIEF DESCRIPTION OF THE DRAWINGS

This present invention is explained with reference to the following drawings.

DETAILED DESCRIPTION OF THE EMBODIMENTS

Referring now to FIGS. 1–4, a coin sorting apparatus in accordance with one preferred embodiment of the present invention will be generally described. The apparatus is adapted to handle several different sized coins of a given currency, for example, 1, 5, 10, 25, 50, and 100 cent coins of U.S. currency may be handled by this apparatus.

Figure 1:
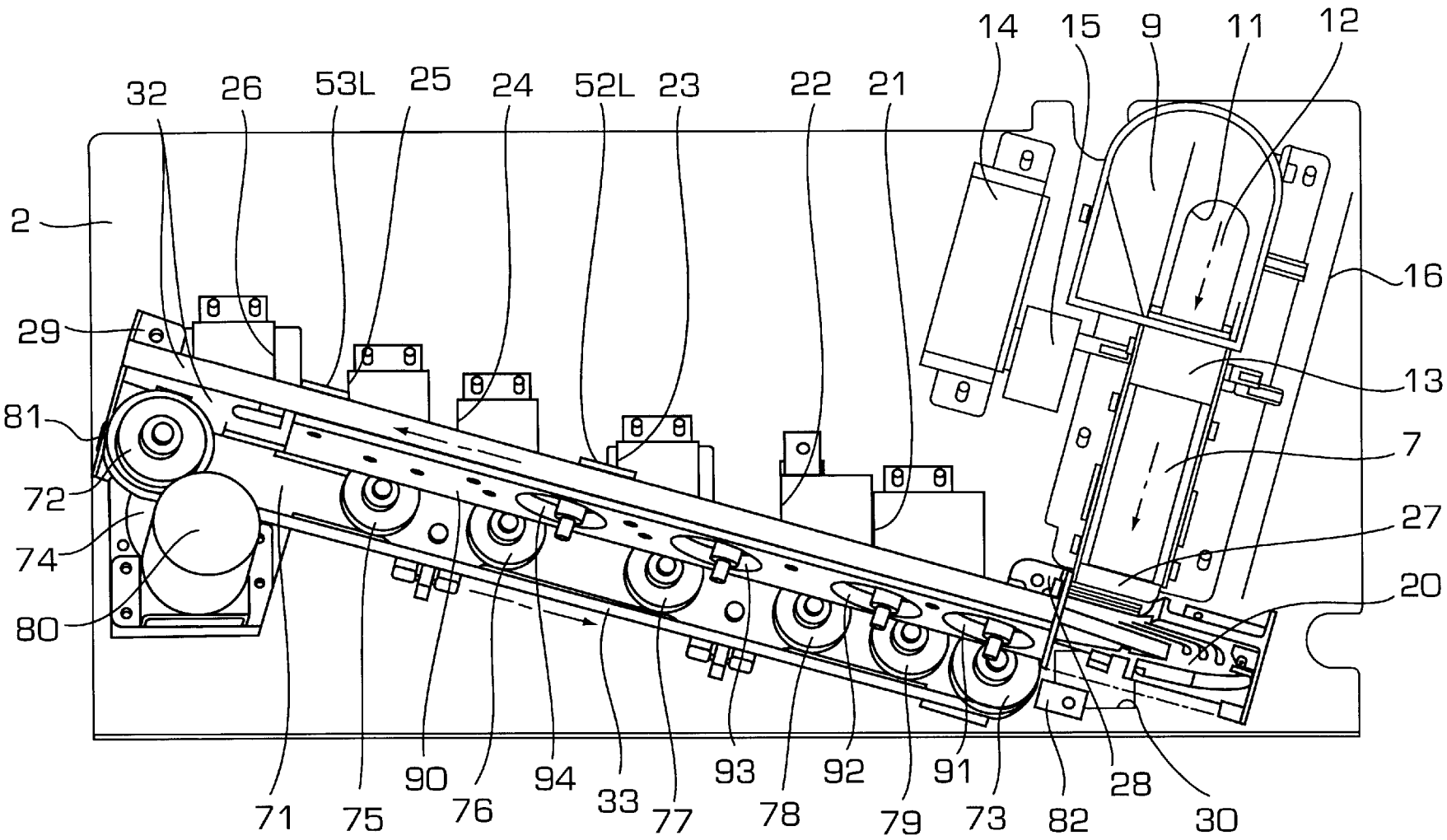
FIG. 1 is a plan view of a coin sorting apparatus according to the present invention.

At first, all of the coins to be separated, regardless of size, are supplied into a funnel-shaped hopper 9. The coins supplied into the hopper 9 will drop onto an endless flat belt-type conveyer 12 through an elongated hole 11 which is formed in the bottom of the hopper 9, as seen in FIG. 1. The coins will be carried away from the hole 11 in the hopper 9 by the conveyer 12. The width of the elongated hole 11 is sized in consideration of the diameter of the largest coin (e.g., 1 dollar coin). Where coins for other currencies are processed, the hole may be sized for the diameter of the largest coin for that currency. Therefore, a plurality of different sized coins for a given currency may coins be arranged in a line on the conveyer 12. Since several of the coins carried in a line on conveyor 12 may be piled on top of one another, the coins are leveled or separated by a reverse roller 13, which rotates in the direction opposite to the conveying direction of the conveyer 12.

The series of leveled or flattened coins are further carried away from the hopper 9 by a second flat belt-type conveyer 7 (FIG. 1). The belt of conveyer 7 rotates faster than the belt of conveyer 12. Thus, the coins arranged flat and in a line on the conveyer 12 will still be arranged in a line and also will become properly spaced from each other on the conveyer 7. Finally, the coins are dropped from the end of the conveyer 7 one-by-one.

The coins dropping one-by-one from the flat belt conveyer 7 fall through a slot 27, serving as an input to a coin selector 20. The selector 20 is disposed below the surface of the conveyor 7 and, when a coin falls therein through slot 27, it becomes arranged in an upright position with a slight slant. Each of the coins that enter the selector 20 is judged electrically as to whether it is true or false during its free fall by gravity into the selector 20. Only a part of the coin selector 20 is shown in the figures.

Figure 4:
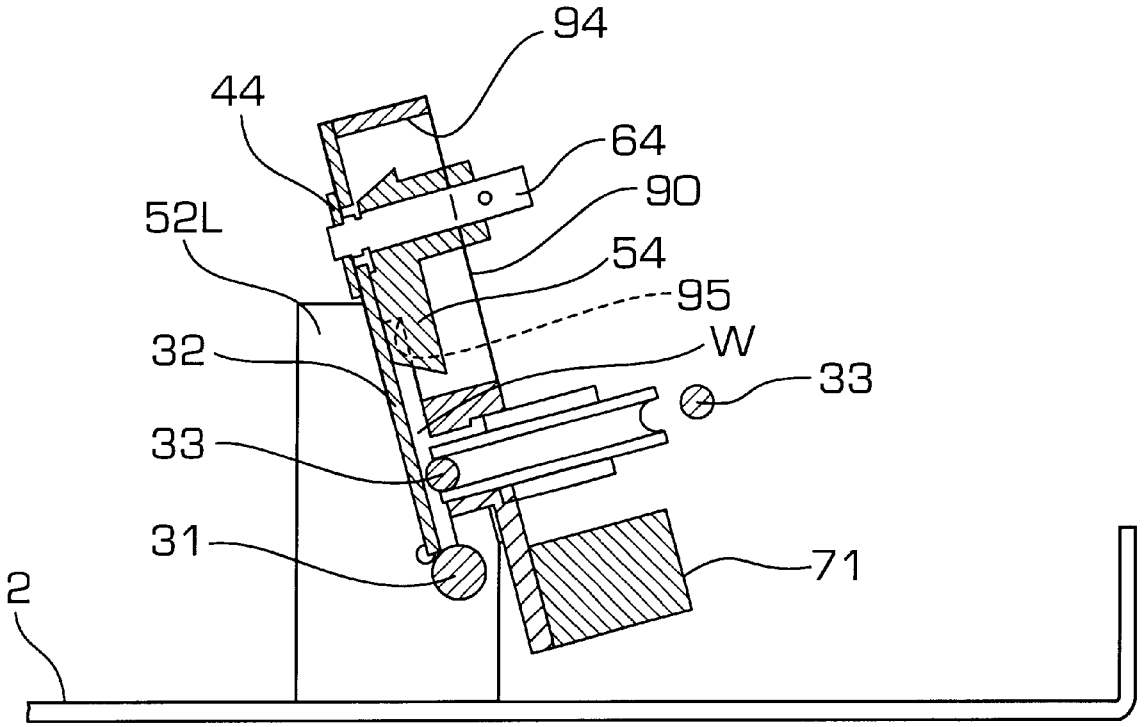
FIG. 4 is an enlarged sectional view of a part of the apparatus seen from the left side in FIG. 2.

Turning specifically to the coin selector 20, this device is provided with a detection coil (not shown) disposed along the coin path and the detection coil is connected to an oscillator (not shown). When a coin comes close to the coil, the impedance of the coil will change and, consequently, the oscillator will change its output frequency and level. The amount of such change will vary, depending on the diameter, thickness and materials of the coin. It is possible to easily discriminate various kinds of coins, and even determine whether the passing coin is true or false, by comparing the amount of the change corresponding to a passing coin with standard values. The comparison of a directed value may be made in a conventional manner by a provision against standard values that are stored in memory with respect to the different coins of interest. The coins pass through and exit from the coin selector 20, rolling by the effect of gravity. The coins will ride on an elongated rail 31 (see FIG. 5) in a standing posture and will roll on their round edges. A section of the rail 31 also is shown in FIG. 4.

Each of the coins standing on the rail 31 is kept in a standing posture with a slight slant by a cord-type belt (not shown) forming a large loop. The coins are conveyed along an elongated guide plate 32 (see FIG. 5) in the leftward direction in FIGS. 1 and 2. In FIG. 1, when a one dollar coin having the largest diameter, for example, is conveyed in the leftward direction, the coin will pass in front of a window hole 1 for a 10 cent coin (see FIG. 5), a window hole 50 for a one cent coin, a window hole 5 for a 5 cent coin, a window hole 100 for a 25 cent coin, and a window hole 10 for a 50 cent coin in this order and, finally, will fall into a window hole 500 for a 1 dollar coin, which window holes are formed through the elongated guide plate 32. The 1 dollar coin, having fallen into the window hole 500, falls through a hole 26 (see FIGS. 1 and 2) formed in a horizontal large base plate 2, which is one of elements composing the coin sorting apparatus. Then, the coin falls further into a 1 dollar coin store device 500H which is shown by a broken line in FIG. 2 and, finally, the coin is stored therein. Similarly, the 10 cent, one cent, 5 cent, 25 cent and 50 cent coins will fall into respective window holes and, having fallen into a respective window hole, will fall through a respective hole in plate 2 (21, 22, 23, 24, 25), and will be stored in a corresponding device (1H, 50H, 5H, 100H, 10H).

Figure 5:
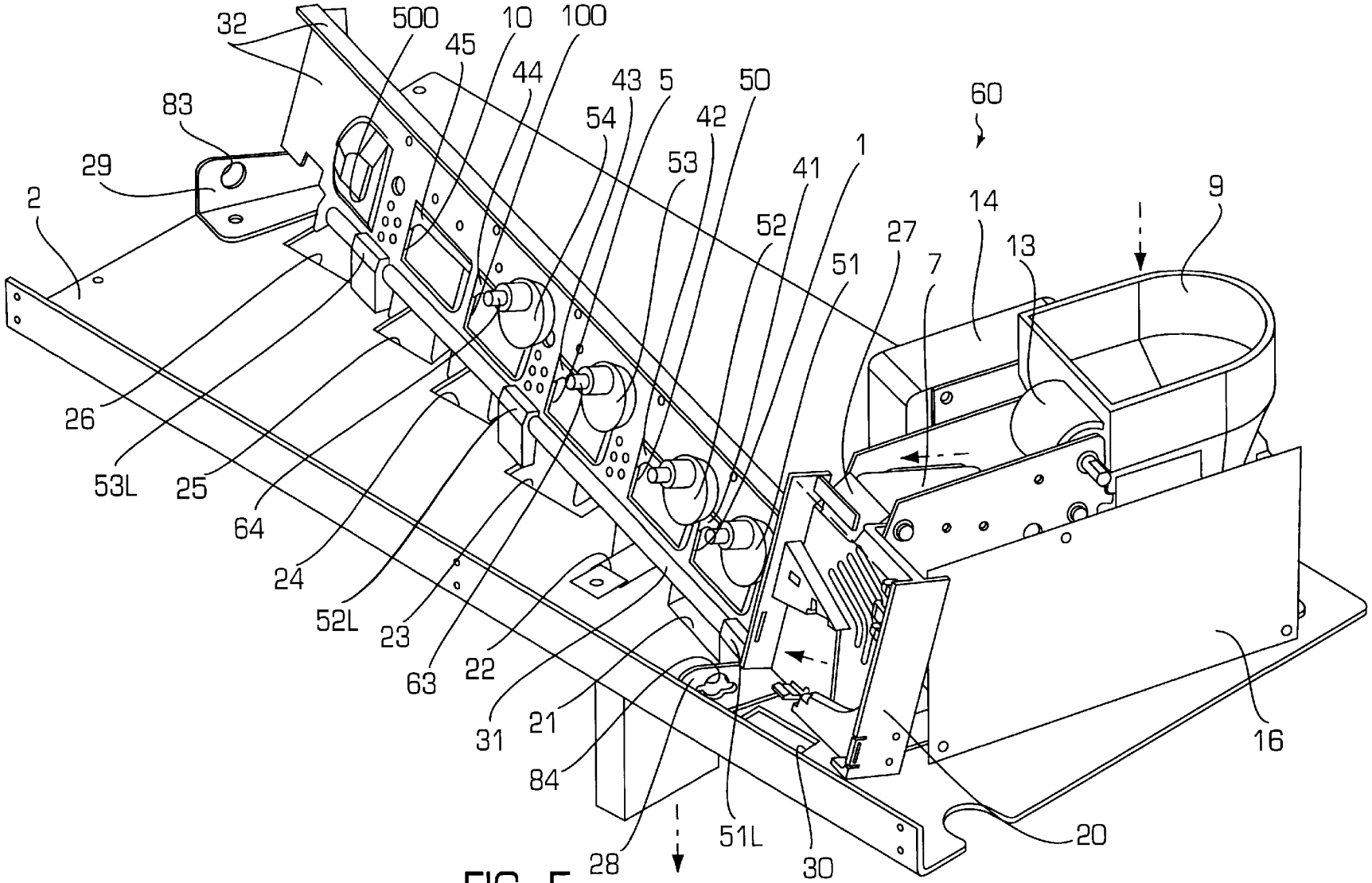
FIG. 5 is a perspective view of a sorting device unit that is one of the two units which compose the apparatus.

FIG. 5 shows the structure that serves to sort coins, as a part of the above-mentioned coin sorting apparatus. The coin sorting structure 60, can be constructed as a unit that can be disassembled from the overall apparatus, in order to accommodate different currencies, in a preferred embodiment. This sorting device unit 60 will be explained in more detail. Specifically, in FIG. 5, at the right end portion of the large rectangular base plate 2, the hopper 9 which arranges the coins into a line, the flat belts 7 and 12, the reverse roller 13 a motor 14 driving the aforementioned elements 7, 12, 13, a gear line structure 15 (not shown), and circuit boards 16 and 17 (not shown) are joined with the coin selector 20 into an assembly for discriminating the kinds of the coins. A hole 30, that is formed in the base plate 2 and shown beneath the coin selector 20, is provided for discharging and returning the coins whose reception has been canceled.

In FIG. 5, the above-mentioned elongated guide plate 32 extends obliquely from the coin selector 20, which is disposed in the right forward part of the base plate 2, toward the left rearward part of the base plate 2. This guide plate 32, as shown in FIG. 5, is fixed by means of relatively large L-shaped flanges 28 and 29 at its both ends to the base plate 2. The elongated guide plate 32 is made of an electrically conductive material, preferably steel, brass or aluminum plate, and is supported at its center portion by approximately L-shaped legs 51L, 52L, 53L that consist of an insulating resin. Further, as shown in FIG. 7, the leg 51L is formed lower in height than the other legs in order to provide a larger space for assembly.

In a preferred embodiment, the elongated rail 31 also is electrically conductive and is held securely by curved projections located at the lower portions of the legs 51L, 52L, 53L, as shown in FIG. 4. Consequently, when an electrically conductive coin on the rail 31 leans on the slant guide plate 32, the coin causes an electrical connection to be made between the conductive rail 31 and the conductive guide plate 32. This electrical connection can be naturally utilized to provide signals related to the operation of the apparatus.

Figure 7:
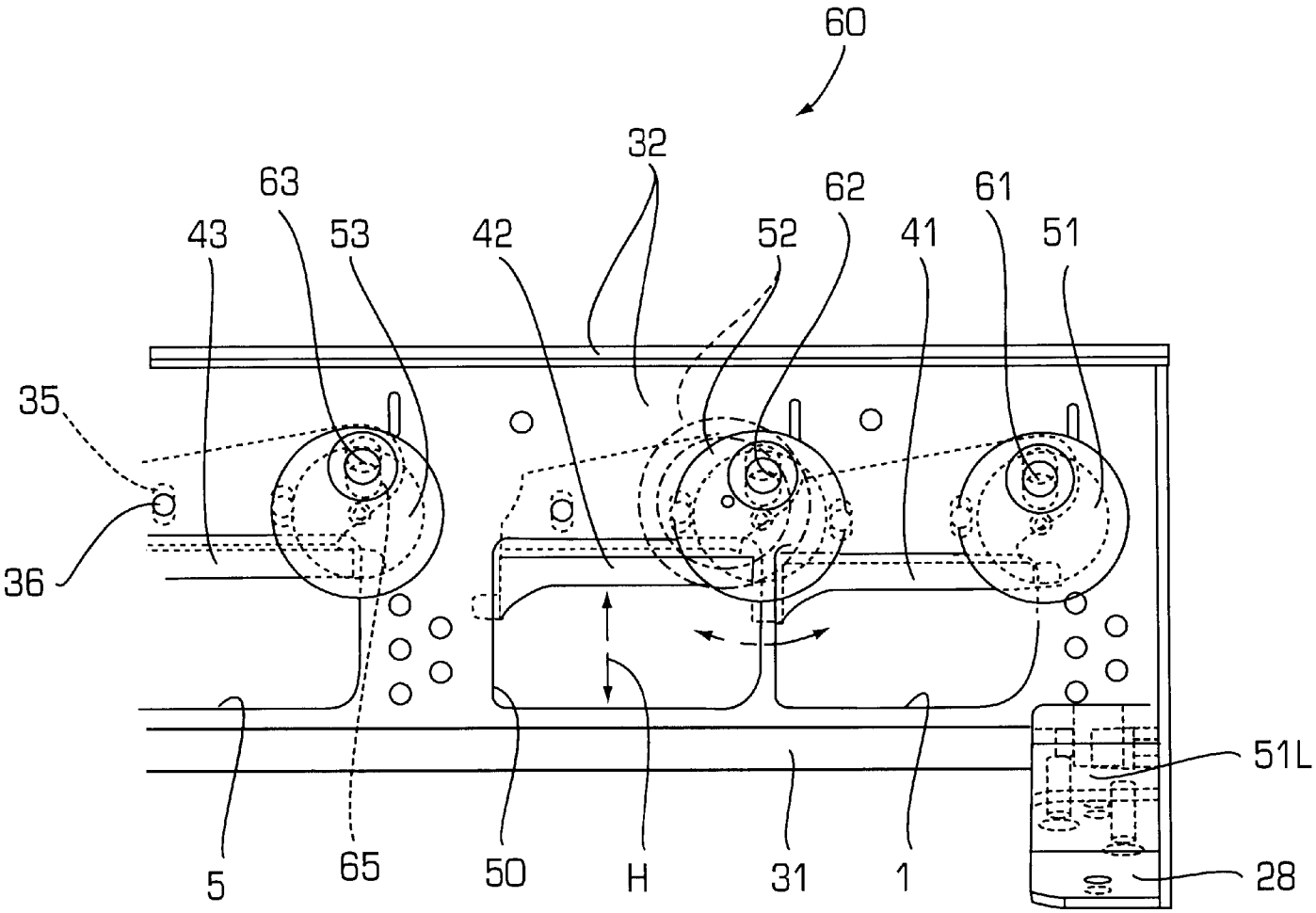
FIG. 7 is an enlarged front view of a part of the apparatus in FIG. 5.

FIG. 7 shows a part of the aforementioned window holes 1, 50, 5, 100, 10, 500 on a larger scale. The height H of hole 50, for example, is formed out of consideration of the diameter of a 1 cent coin, and a 1 cent coin sliding on the guide 32 then falls into this window hole 50.

The height H of the window hole 50 is determined by an approximately rectangular and slightly small adjustable plate 42, which is disposed on the backside of the guide plate 32. Also, adjustable plates 41, 43, 44, 45 are arranged respectively for the other window holes 1, 5, 100 and 10, except the window hole 500. The adjustable plates 41, 42, 43, 44, 45 can be adjusted easily upward and downward by the use of elongated holes 35 of the adjustable plates 41, 42, 43, 44, 45 and screw holes 36 of the guide plate 32 and the like. A plurality of truncated cones located above these windows act as swing members 51, 52, 53, 54, which can swing freely left and right by a light force as shown in FIG. 7. In other words, the swing members are arranged such that they hang down by their weight to cover the right upper portions of the windows 1, 50, 5, 100 and can swing freely along the surface of the guide plate 32.

The swing members 51, 52, 53, 54 prevent the coins, which are running fast on the cord-type belt 33, from vibrating. The swing members suppress the vibration of the coins by applying a force to their top-most periphery. The swing members 51, 52, 53, 54 are hung by pins 61, 62, 63, 64 that are fixed in the right upper parts of the adjustable plates 41, 42, 43, 44, respectively, such that the members can swing freely. In other words, the members 51 to 54 are hung at their centers of gravity. Since the pins 61, 62, 63, 64 are fixed on the adjustable plates 41 to 44 through the elongated holes 65 of the guide plate 32, the pins can move freely when the adjustable plates are adjusted upward or downward. The swing members 51, 52, 53, 54 are integrally assembled together with the adjustable plates 41, 42, 43, 44, respectively As the result, when each position of the adjustable plates 41, 42, 43, 44 is simply adjusted, each of swing members 51, 52, 53, 54 is provided at a suitable position, respectively.

Figure 6:
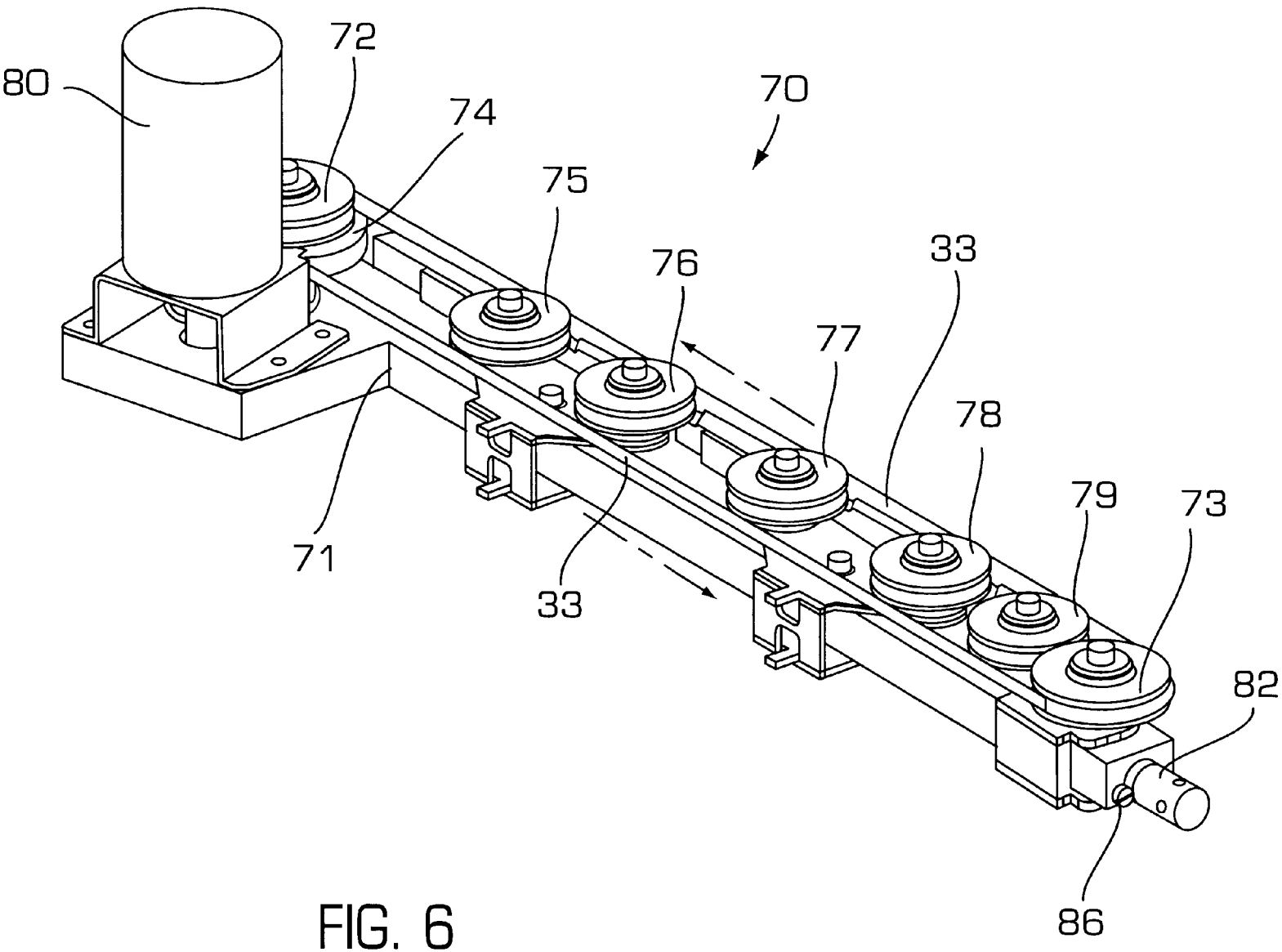
FIG. 6 is a perspective view of a cover device unit that is the other one of the two units which compose the apparatus.
Figure 8:
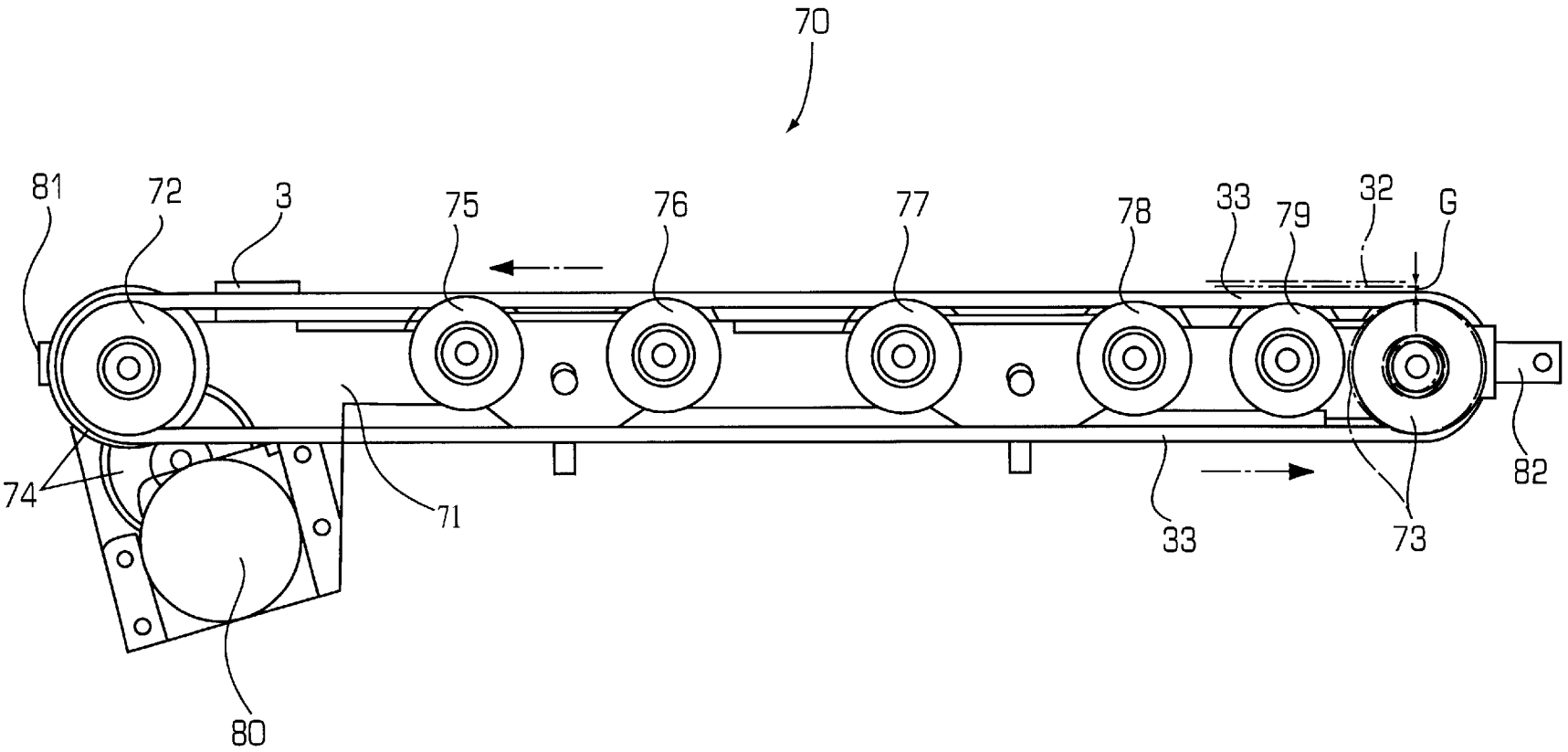
FIG. 8 is a plan view of the unit in FIG. 6.

FIG. 6 shows a cover device unit 70 which can be assembled with the sorting device unit 60 shown in FIG. 5. The cover device unit 70 comprises, as shown in FIGS. 6 and 8, an elongated thick base plate 71 made of aluminum, steel, brass or the like, which is generally shaped in the form of the number 7. A drive pulley 72 is arranged rotatably on the left end portion of the base plate 71. An eccentric pulley 73 is arranged rotatably on the right end portion of the base plate 71, and guide pulleys 75, 76, 77, 78, 79 are arranged rotatably and swingably between the drive pulley 72 and the eccentric pulley 73. A cord-type belt 33 is installed on the pulleys 72 to 79, and a gear structure 74 and motor 80 are used to rotate the drive pulley 72.

In FIG. 8, a slope tab 3 is formed on the base plate 71. This slope tab 3 will be placed on the rail 31, when the cover device unit 70 is assembled with the sorting device unit 60. Slope tab 3 serves to guide one dollar coins that move on the rail 31 and come near into the window hole 500. Since the rotation axis of the eccentric pulley 73 is deviated from the center of the pulley 73, when the motor 80 is energized and the cord-type belt 33 is rotated counterclockwise as shown in FIG. 8, the periphery of the eccentric pulley 73 alternately comes close to and away from the guide plate 32. As the result, the cord-type belt 33 opens or closes the gap G between the guide plate 32 and itself as it moves.

The gap G formed between the guide plate 32 and the cord-type belt 33 will be alternately opened and closed as shown in FIG. 8. Therefore, any coin coming from the right side of FIG. 8 will be caught between the changing gap G regardless of the coin thickness, and will be accurately and effectively further conveyed. As shown in FIG. 8, the base plate 71 is provided at the left end of the illustration with a projecting shaft 81 that is used for assembly, and at the right end with a threaded shaft 82 that is screwed into the base plate 71 and used for assembly and fixing. Prior to assembling the cover device unit 70 onto the sorting device unit 60, a small elongated thick cover plate 90, which preferably may be made of plastic, is disposed on the inner surface of the guide plate 32, as shown in FIGS. 1 and 2.

Figure 2:
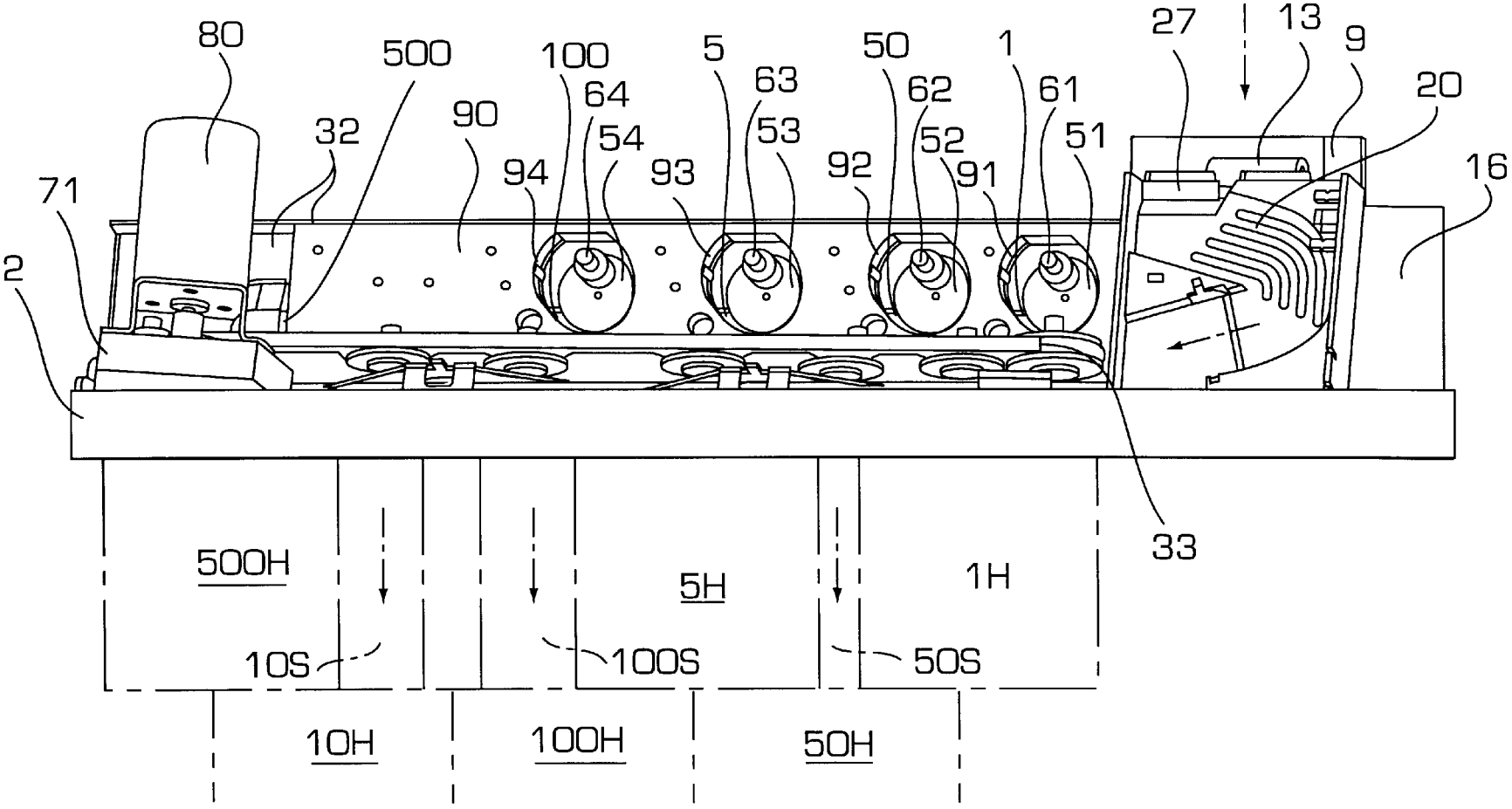
FIG. 2 is a front view of the apparatus shown in FIG. 1.

As seen in FIG. 2, circular holes 91, 92, 93, 94 are formed in the cover plate 90 and are covered freely or swingably by the swing members 51–54, respectively. The cover plate 90 is also provided with a groove 95 along its length at the lower portion of its backside. The groove 95 forms a path W, as shown in FIG. 4, so as to allow a plurality of kinds of coins to pass along it one-by-one. The path W, which conveys the coins with an upright orientation and at a slight slant, is defined by the bottom of the rail 31, the lower side wall of the guide plate 32, the upper side wall of the cover plate 90 and the cord-type belt 33.

Figure 3:
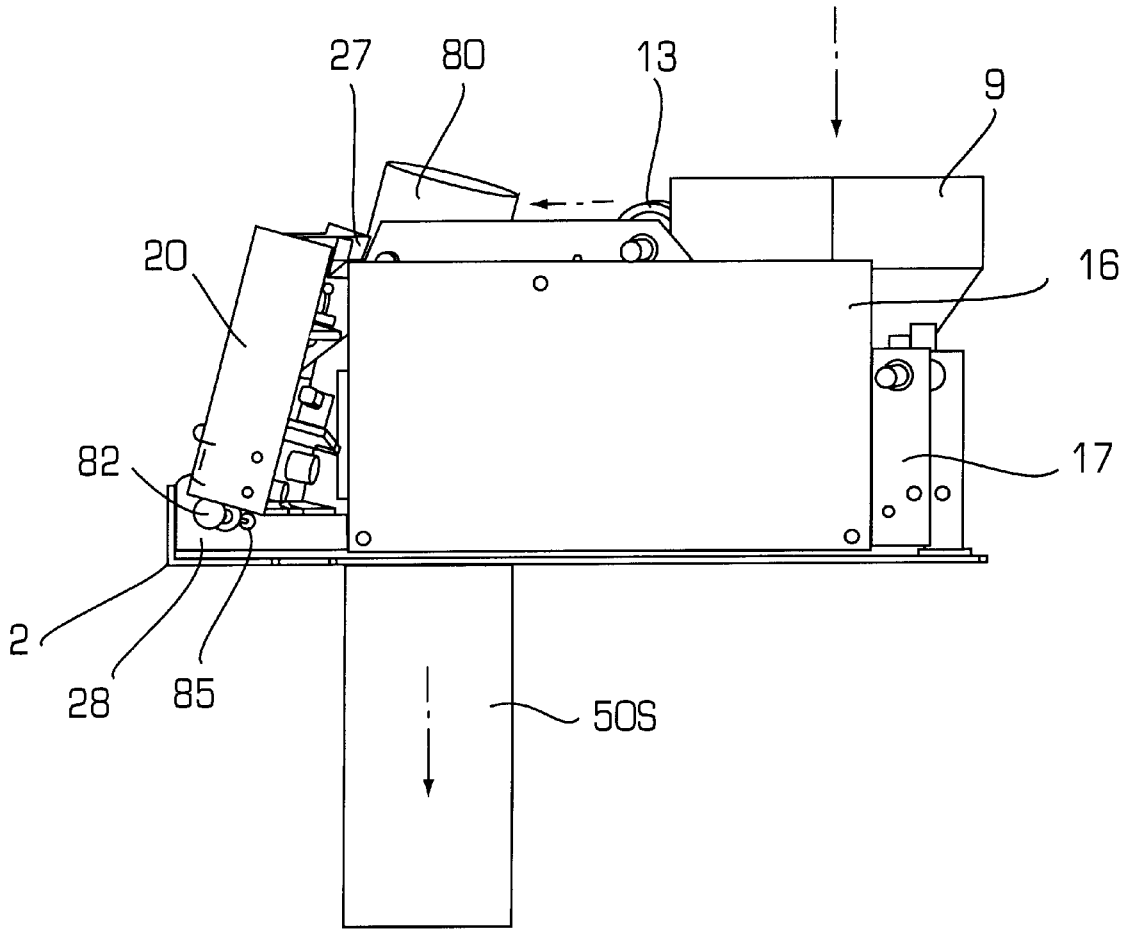
FIG. 3 is a side view of the apparatus seen from the right side in FIG. 2.

Turning again to FIG. 6, the cover unit 70 is installed into the sorting device unit 60 in a manner seen in FIG. 5. In this case, firstly, the threaded shaft 82 is removed from the base plate 71 and the projecting shaft 81 of the base plate 71 is inserted into the hole 83 (see FIG. 5) of the flange 29. Next, the right end of the base plate 71 is positioned so as to face the hole 84 of the flange 28 and the threaded shaft 82 is screwed into the base plate 71 from outside, fixing it to the sorting device unit 60. Further, small screws 85 and 86, as shown in FIGS. 3 and 6, respectively, are provided for the purpose of securing the arrangement in which the cover device unit 70 has been installed onto the sorting device unit 60.

In the preferred embodiment, as previously described, the flat belts on conveyors 7 and 12, and the cord-type belt, will be run in the arrow direction shown in the drawing, when the motors 14 and 80 are energized. When a plurality of coins, which may be of different sizes and denominations, are supplied into the hopper 9, the coins will be conveyed out of the hopper 9 and arranged separately in a line by means of the flat belt on conveyor 12, the reverse roller 13, and the flat belt of conveyor 7, as mentioned above. The plurality of coins, which may be of different sizes and are conveyed separately, drop one-by-one from the flat belt of conveyor 7 through slot 27. Then, each coin is slotted into the coin selector 20, which arranges the coin in a standing posture with a slight slant. The coin slotted into the coin selector 20 falls freely by its weight within the coin selector 20 and the coin in front is discriminated electrically during its free fall to determine whether it is false or true, and then, to determine its denomination, as mentioned above. In the latter regard, the coin is sent out of the coin selector 20 according to its free fall ride on the elongated rail 31. Simultaneously, the coin is drawn effectively in the leftward direction in FIGS. 1 and 2, by means of the cord-type belt 33 which comes alternately close to and away from the elongated guide plate 32, and travels along the elongated guide plate 32.

The coin conveyed in the leftward direction falls into the one of the window holes, whose diameter corresponds to the diameter of the coin, wherein the window holes include the window hole 1 for a 10 cent coin, the window hole 50 for a 1 cent coin, the window hole 5 for a 5 cent coin, the window hole 100 for a 25 cent coin, the window hole 10 for a 50 cent coin, and the window hole for a 1 dollar coin which are formed in the guide plate 32. A 10 cent coin having fallen into the window hole 1 falls further and is stored in a 10 cent coin store device 1H which is shown by a broken line in FIG. 2, and a 1 cent coin having fallen into the window hole 50 falls further through a chute 50S and is stored in a 1cent coin store device 50H. In like manner, a 5 cent coin having fallen into the window hole 5 falls further and is stored in a 5 cent coin store device 5H, and a 25 cent coin having fallen into the window hole 100 falls further through a chute 100S and is stored in a 25 cent coin store device 100H which is shown by broken lines in FIG. 2.

A 50 cent coin having fallen into the window hole 10 falls further through a chute 10S and is stored in a 50 cent coin store device 10H, and a one dollar coin having fallen into the window hole 500 falls further and is stored in a one dollar coin store device 500H.

It is clear from the above descriptions that the path W in which the coins separately roll in an upright standing posture with a slight slant in relation to the vertical direction could be also arranged obliquely (not shown in the drawings) in relation to the horizontal surface that differs from the path W in FIG. 2, which path W is arranged at a level. In other words, if the path is formed so that the coins can rotate and move through the path W by their own weight, i.e., if the rail 31 as the bottom of the path and the guide plate 32 as the lower side wall to support the moving coins are arranged obliquely, plural kinds of the coins will be automatically sorted only by the effect of gravity.

Incidentally, it would be well-known to one of ordinary skill that the cord-type belt 33 as an element forming the path W may be replaced by a flat belt, and that the cord-type belt 33 may be of a conductive type. If the cord-type belt 33 is replaced with a flat belt, the cover plate 90 may be eliminated thereby.

As described above, the coin sorting apparatus according to the present invention is constituted so that plural kinds of coins can move in a substantially standing posture along a straight path. Of course, the path also could be arranged in a coil spring-like spiral. In any event, the size of the apparatus becomes smaller and the coin store space for plural kinds of the coins thereby becomes larger. Where the present invention uses the straight path, if it is necessary to provide the coin store devices for each kind of the coins, the devices may be arranged three-dimensionally, namely the whole structure of the apparatus can be arranged so as to extend vertically. Therefore, the design flexibility of the arrangement will be increased and the space for the arrangement also will be preferably saved, and these allow the apparatus to be applied to a wider field of industry. In particular, maintenance and inspection of the apparatus becomes very much easier, since the apparatus is divided into the two units While the present invention has been described in accordance with certain preferred embodiments, the present invention is not limited thereto and the invention is to be defined solely in accordance with the claims.

What is claimed is:

1. A coin sorting apparatus comprising a separating device unit and a cover device unit having an upper side, said apparatus comprising at least a bottom surface and a side cover wall means for defining a path along which plural kinds of coins move separately in a standing posture with a slant, wherein said side cover wall means comprises a movable portion and a guide wall; and wherein said movable portion is operative to open and close a space between itself and said guide wall.

2. A coin sorting apparatus according to claim 1, characterized in that a bottom plate defines said bottom surface and constitutes the path, and wherein said plate has disposed thereon at least one eccentric pulley that forms a part of said moveable portion.

3. A coin sorting apparatus according to claim 1 wherein said separating device unit further comprises conveyor means for separating coins and arranging said coins in series.

4. A coin sorting apparatus according to claim 1, wherein said separating device unit further comprises a coin selector for judging the identity of a coin.

5. A coin sorting apparatus according to claim 1, characterized in that said moveable portion comprises an eccentric pulley and a belt.

6. A coin sorting apparatus comprising at least:

a lower side guide wall for defining a path along which plural kinds of coins move separately in a standing posture with a slant; and a plurality of window holes for sorting the coins, said holes being formed in said guide wall and have diameters corresponding to those of the coins and are arranged from the smallest to the largest in order of diameter size and further is characterized in that upper portions of a plurality of said window holes are covered with a swing member, adapted to freely swing about an offset axis, respectively, and to damp coin vibration.

7. A coin sorting apparatus according to claim 6, characterized in that a bottom plate having a surface is provided for defining the path.

8. A coin sorting apparatus according to claim 7, characterized in that the bottom plate surface is electrically conductive.

9. A coin sorting apparatus according to one of claim 6, characterized in that a plurality of said window holes are provided with an adjust means for adjusting the size thereof, respectively.

10. A coin sorting apparatus according to claim 9, characterized in that each of the adjust means and each of the swing members are coupled integrally.

11. A coin sorting apparatus comprising at least a coin separating device unit comprising:

a guide wall for constituting a path through which plural kinds of coins move separately one by one in a substantially standing posture;

a plurality of window holes for sorting the coins which holes are formed in said guide wall and have diameters corresponding to those of the coins and are arranged from the smallest to the largest in order of diameter size; and a bottom surface comprising the path, wherein each of said window holes is provided with a size adjust means and is covered by a swing member.

12. A coin sorting apparatus according to claim 11, characterized in that said bottom surf ace is electrically conductive.

13. A coin sorting apparatus according to claim 11, characterized in that said bottom surface comprises a conductive rail.

14. A coin sorting apparatus according to claim 11, characterized in that each of the upper portions of said window holes is covered with a swing member eccentrically rotatable.

15. A coin sorting apparatus according to claim 14, characterized in that said window holes is provided with an adjust means and that each of said adjust means and each of swing members are coupled integrally.

16. A coin sorting apparatus comprising at least:

a) a cover device unit for assisting the conveyance of coins; and b) a separating device unit comprising:

a guide wall for defining a path along which plural kinds of coins can move separately one by one in a standing posture with a slant;

a plurality of window holes for sorting the coins, said holes being formed in said guide wall and have diameters corresponding to those of the coins and being arranged from the smallest to the largest in order of diameter size; and a bottom surface for defining said path; and wherein said cover device unit comprises a side wall means for further defining the path, a portion of said side wall means being movable; and said moveable portion of said side wall means opens and closes a space between itself and said guide wall.

17. A coin sorting apparatus according to claim 16, characterized in that said bottom surface is electrically conductive.

18. A coin sorting apparatus according to claim 17, characterized in that said window hole is provided with an adjust means respectively.

19. A coin sorting apparatus according to claim 16, characterized in that the upper portions of each said window hole is covered with a swing member, respectively.

20. A coin sorting apparatus according to claim 19, characterized in that each of a plurality of said window holes is provided with a size adjust means, and that each of said size adjust means and each of the corresponding swing members are coupled integrally.

21. A cover device unit for a coin sorting apparatus comprising a coin path, an oscillating apparatus, a base plate supporting said oscillating apparatus, and a guide structure having a moveable portion and a stationary portion defining said coin path, said movable portion being movable by said oscillating apparatus to guide coins in a series and in a substantially upright position along said coin path.

22. A cover device according to claim 21, wherein said oscillating apparatus comprises an eccentric pulley and said motor driving said pulley.

23. A cover device according to claim 22, wherein said moveable portion of said guide structure comprises a belt that is oscillated by said oscillating apparatus.

24. A cover device according to claim 23, wherein said stationary portion of said guide structure comprises cover plate having a side wall defining said coin path.

* * * * *